US008303105B2

(12) United States Patent
Kato

(10) Patent No.: US 8,303,105 B2
(45) Date of Patent: Nov. 6, 2012

(54) MEDIUM FEEDING APPARATUS AND IMAGE RECORDING APPARATUS

(75) Inventor: Shigeki Kato, Toyoake (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 255 days.

(21) Appl. No.: 12/874,086

(22) Filed: Sep. 1, 2010

(65) Prior Publication Data

US 2011/0157285 A1 Jun. 30, 2011

(30) Foreign Application Priority Data

Dec. 29, 2009 (JP) ..... 2009-299201

(51) Int. Cl.
*B41J 2/01* (2006.01)
*B65H 5/02* (2006.01)
*B65H 29/30* (2006.01)

(52) U.S. Cl. ..... 347/104; 271/275; 271/193

(58) Field of Classification Search ..... None
See application file for complete search history.

(56) References Cited

U.S. PATENT DOCUMENTS 5,531,436 A * 7/1996 Ohyama et al. ..... 271/275

FOREIGN PATENT DOCUMENTS

EP 0693381 A1 1/1996
JP H07-137877 A 5/1995
JP H07-330185 A 12/1995
JP 2000-143024 A 5/2000
JP 2007-230035 A 9/2007
JP 2009-023773 A 2/2009

OTHER PUBLICATIONS

Japan Patent Office, Notification of Reason for Refusal for Japanese Patent Application No. 2009-299201 (counterpart to above-captioned patent application), dispatched Dec. 6, 2011.
European Patent Office, extended European Search Report for European Patent Application No. 10009008.3 (counterpart to above-captioned patent application), dated Feb. 28, 2012.
Japan Patent Office, Decision to Grant a Patent for Japanese Patent Application No. 2009-299201 (counterpart to above-captioned patent application), dispatched Mar. 6, 2012.

* cited by examiner

*Primary Examiner* — Geoffrey Mruk
*Assistant Examiner* — Bradley Thies
(74) *Attorney, Agent, or Firm* — Baker Botts L.L.P.

(57) ABSTRACT

A medium feeding apparatus including: a feeding mechanism including a feeding member and configured to feed the recording medium; an adsorbing unit including first and second electrodes facing the feeding member and configured to adsorb the recording medium to the feeding member; first and second surface layer members respectively having higher volume resistivities than the first and second electrodes and respectively stacked on the first and second electrodes; and first and second low resistance members respectively having lower volume resistivities than the first and second surface layer members and respectively fixed to the first and second surface layer members at positions between the respective first and second surface layer members and the feeding member, wherein the first low resistance member and the second low resistance member are distant from each other.

16 Claims, 7 Drawing Sheets

MEDIUM FEEDING APPARATUS AND IMAGE RECORDING APPARATUS

CROSS REFERENCE TO RELATED APPLICATION

The present application claims priority from Japanese Patent Application No. 2009-299201, which was filed on Dec. 29, 2009, the disclosure of which is herein incorporated by reference in its entirety.

BACKGROUND OF THE INVENTION

1. Field of the Invention

The present invention relates to a medium feeding apparatus and an image recording apparatus configured to feed a recording medium while adsorbing the recording medium to a feeding member.

2. Description of the Related Art

There is known an apparatus configured to feed a recording medium while adsorbing the recording medium to a feeding member. In this apparatus, the recording medium on a feeding face of the feeding member (a sheet feeding belt) is adsorbed to the feeding face by using an electrode provided on an opposite side of the feeding face.

SUMMARY OF THE INVENTION

In the above-described adsorbing apparatus, since electric charges are accumulated between a surface layer member of the electrode and the feeding member and thereby an attractive force is generated between the surface layer member of the electrode and the feeding member, the attractive force acts as a resistance of a movement of the feeding member. In order to solve this problem, a material having a low frictional coefficient is used for the surface layer member of the electrode and the feeding member in the adsorbing apparatus. However, only this measurement is insufficient.

This invention has been developed in view of the above-described situations, and it is an object of the present invention to provide a medium feeding apparatus and an image recording apparatus including a feeding member having a low movement resistance.

The object indicated above may be achieved according to the present invention which provides a medium feeding apparatus comprising: a feeding mechanism including a feeding member having a medium-placed face on which a recording medium is placed, the feeding mechanism being configured to feed the recording medium placed on the medium-placed face of the feeding member by moving the feeding member along a predetermined path; an adsorbing unit including a first electrode and a second electrode each having a face facing a back face of the feeding member which back face is a face on the opposite side of the medium-placed face, the adsorbing unit being configured to adsorb the recording medium located on the medium-placed face to the medium-placed face by generating a potential difference between the first electrode and the second electrode; a first surface layer member formed of a material having a higher volume resistivity than the first electrode and stacked on one of opposite faces of the first electrode which one is nearer to the back face of the feeding member than the other of the opposite faces thereof; a second surface layer member formed of a material having a higher volume resistivity than the second electrode and stacked on one of opposite faces of the second electrode which one is nearer to the back face of the feeding member than the other of the opposite faces thereof; a first low resistance member formed of a material having a lower volume resistivity than the first surface layer member and fixed, at a position between the first surface layer member and the feeding member, to one of faces of the first surface layer member which one faces the back face of the feeding member; and a second low resistance member formed of a material having a lower volume resistivity than the second surface layer member and fixed, at a position between the second surface layer member and the feeding member, to one of faces of the second surface layer member which one faces the back face of the feeding member, wherein the first low resistance member and the second low resistance member are disposed so as to be distant from each other.

The object indicated above may also be achieved according to the present invention which provides a medium feeding apparatus comprising: a feeding mechanism including a feeding member having a medium-placed face on which a recording medium is placed, the feeding mechanism being configured to feed the recording medium placed on the medium-placed face of the feeding member by moving the feeding member along a predetermined path; an adsorbing unit including a first electrode and a second electrode each having a face facing a back face of the feeding member which back face is a face on the opposite side of the medium-placed face, the adsorbing unit being configured to adsorb the recording medium located on the medium-placed face to the medium-placed face by generating a potential difference between the first electrode and the second electrode; a surface layer member formed of a material having a higher volume resistivity than any of the first electrode and the second electrode and stacked on the faces of the first electrode and the second electrode; a first low resistance member formed of a material having a lower volume resistivity than the surface layer member and fixed, at a position between the surface layer member and the feeding member, to a face of the surface layer member which faces the back face of the feeding member; and a second low resistance member formed of a material having a lower volume resistivity than the surface layer member and fixed, at a position between the surface layer member and the feeding member, to the face of the surface layer member which faces the back face of the feeding member, wherein the first low resistance member and the second low resistance member are disposed so as to be distant from each other.

The object indicated above may also be achieved according to the present invention which provides a medium feeding apparatus comprising: a feeding mechanism including a feeding member having a medium-placed face on which a recording medium is placed, the feeding mechanism being configured to feed the recording medium placed on the medium-placed face of the feeding member by moving the feeding member along a predetermined path; an adsorbing unit including a first electrode and a second electrode each having a face facing a back face of the feeding member which back face is a face on the opposite side of the medium-placed face, the adsorbing unit being configured to adsorb the recording medium located on the medium-placed face to the medium-placed face by generating a potential difference between the first electrode and the second electrode; a first surface layer member formed of a material having a higher volume resistivity than the first electrode and stacked on one of opposite faces of the first electrode which one is nearer to the back face of the feeding member than the other of the opposite faces thereof; a second surface layer member formed of a material having a higher volume resistivity than the second electrode and stacked on one of opposite faces of the second electrode which one is nearer to the back face of the feeding member than the other of the opposite faces thereof; a first low resistance member formed of a material having a lower volume resistivity than the feeding member and fixed to the back face of the feeding member at a position between the first surface layer member and the feeding member; and a second low resistance member formed of a material having a lower volume resistivity than the feeding member and fixed to the back face of the feeding member at a position between the second surface layer member and the feeding member, wherein the first low resistance member and the second low resistance member are disposed so as to be distant from each other.

The object indicated above may also be achieved according to the present invention which provides an image recording apparatus comprising: the medium feeding apparatus as described in any one of claims 1 to 15; and a recording head configured to perform a recording operation on the recording medium fed by the feeding mechanism.

BRIEF DESCRIPTION OF THE DRAWINGS

The objects, features, advantages, and technical and industrial significance of the present invention will be better understood by reading the following detailed description of embodiments of the invention, when considered in connection with the accompanying drawings, in which.

DESCRIPTION OF THE EMBODIMENTS

First Embodiment

Hereinafter, there will be described a first embodiment of the present invention with reference to FIGS. 1 to 6.

Figure 1:
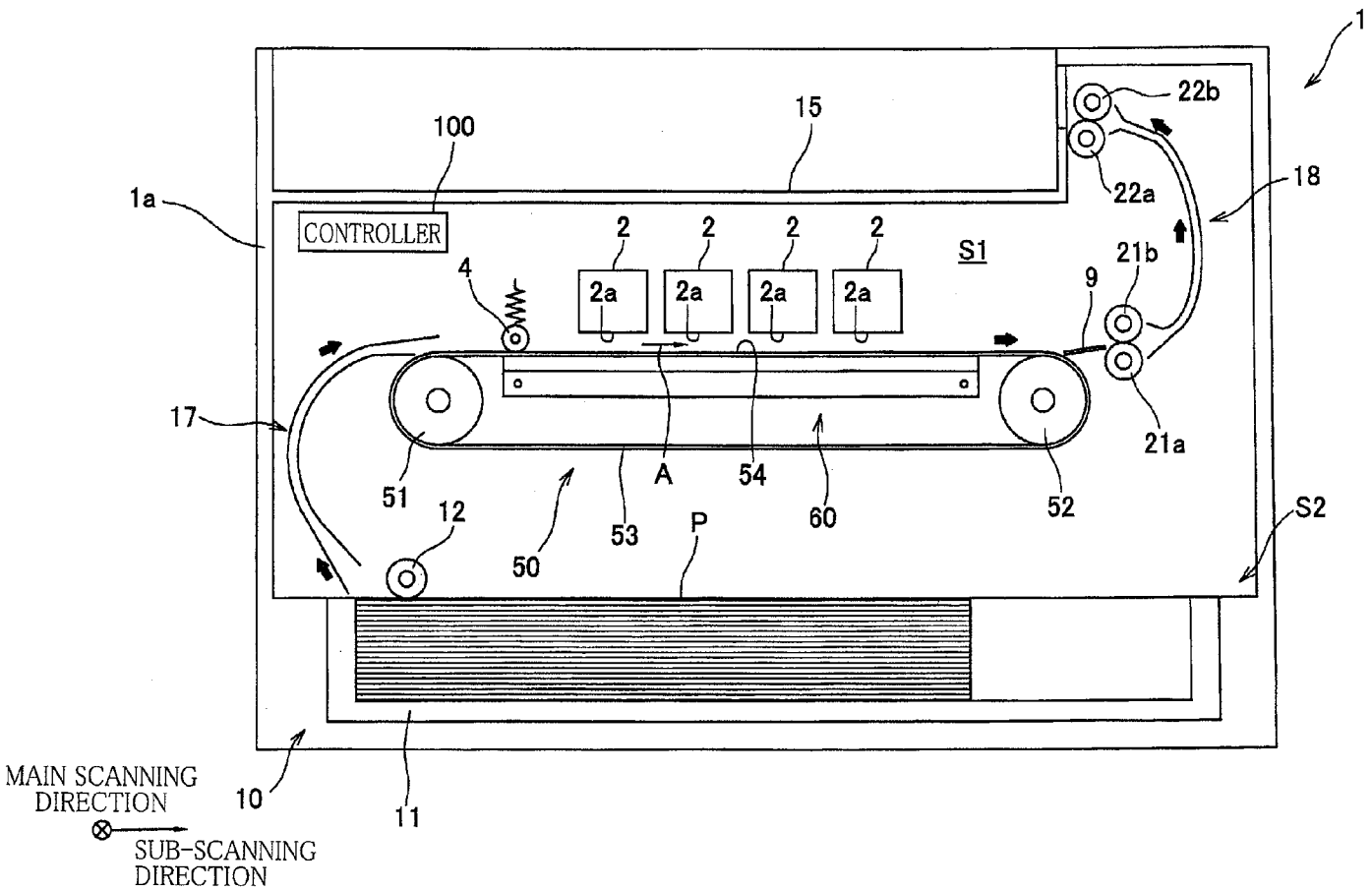
FIG. 1 is a schematic view showing an internal structure of an ink-jet printer as a first embodiment of the present invention.

As shown in FIG. 1, an ink-jet printer 1 as the first embodiment includes (a) a casing 1*a* having a rectangular parallelepiped shape and (b) a sheet-discharge portion 15 at an upper portion of the ink-jet printer 1. An inside of the casing 1*a* is divided into two spaces S1, S2 in order from above. In the space S1, there are disposed in order from the above (a) four ink-jet heads 2 for respectively ejecting inks of four colors, namely, magenta, cyan, yellow, and black and (b) a sheet feeding mechanism 50 configured to feed a sheet P in a sheet feeding direction A. A sheet-supply device 10 is disposed in the space S2. Further, the ink-jet printer 1 includes a controller 100 configured to control operations of these components. It is noted that, in the present embodiment, a direction parallel to the sheet feeding direction A in which the sheet P is fed by the sheet feeding mechanism 50 is defined as a sub-scanning direction while a direction perpendicular to the sub-scanning direction and parallel to a horizontal plane is defined as a main scanning direction.

In the ink-jet printer 1, there is formed a sheet feeding path through which the sheet P is fed from the sheet-supply device 10 toward the sheet-discharge portion 15 along boldface arrow in FIG. 1. The sheet-supply device 10 includes (a) a sheet-supply cassette 11 configured to accommodate therein a plurality of sheets P in a stacked manner, (b) a sheet-supply roller 12 configured to supply each sheet P from the sheet-supply cassette 11, and (c) a sheet-supply motor, not shown, configured to rotate the sheet-supply roller 12 by the control of the controller 100.

The sheet-supply roller 12 is configured to supply an uppermost one of the sheets P accommodated in the sheet-supply cassette 11 in the stacked manner. On a left side of the sheet feeding mechanism 50 in FIG. 1, there is provided a sheet feeding guide 17 curving and extending upward from the sheet-supply cassette 11.

In this configuration, the sheet-supply roller 12 is rotated in a clockwise direction in FIG. 1 by the control of the controller 100 while contacting the uppermost sheet P, thereby supplying the sheet P to the sheet feeding mechanism 50 through the sheet feeding guide 17.

Figure 2:
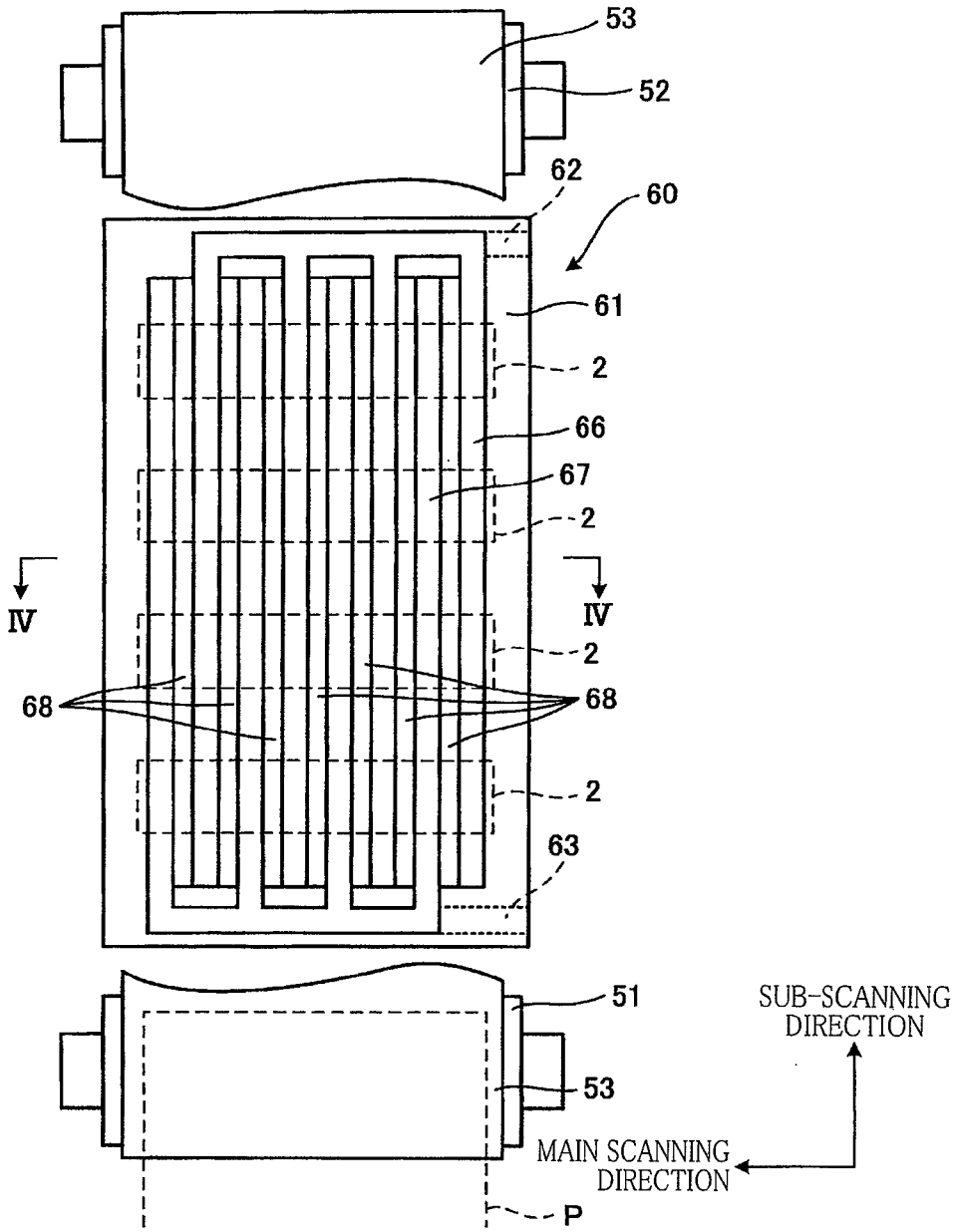
FIG. 2 is a plan view showing a sheet feeding mechanism and its surrounding components in FIG. 1, wherein an illustration of a sheet feeding belt is partly omitted, and thereby an adsorptive platen located under the sheet feeding belt is illustrated.

As shown in FIGS. 1 and 2, the sheet feeding mechanism 50 is disposed at a position facing the four ink-jet heads 2 and includes (a) two belt rollers 51, 52, (b) an endless sheet feeding belt 53 as a feeding member wound around the rollers 51, 52 so as to bridge the rollers 51, 52, (c) a sheet feeding motor, not shown, configured to rotate the belt roller 52 by the control of the controller 100, and (d) an adsorptive platen (an attractive platen) 60 as an adsorbing unit facing the four ink-jet heads 2. The two belt rollers 51, 52 are arranged side by side in the sheet feeding direction A and supported by the casing 1*a* so as to be rotatable.

The sheet feeding belt 53 is formed of, e.g., polyimide and fluoroplastic and has a volume resistivity of about between 108 and 1014 Ω-cm (ohm-cm), e.g., about 1012 Ω-cm, and has a flexibility. Any material may be used for the sheet feeding belt 53 as long as the sheet feeding belt 53 has a volume resistivity and a flexibility similar to the above. A reason why the sheet feeding belt 53 is formed of such a material having a relatively high volume resistivity will be described later.

Figure 3:
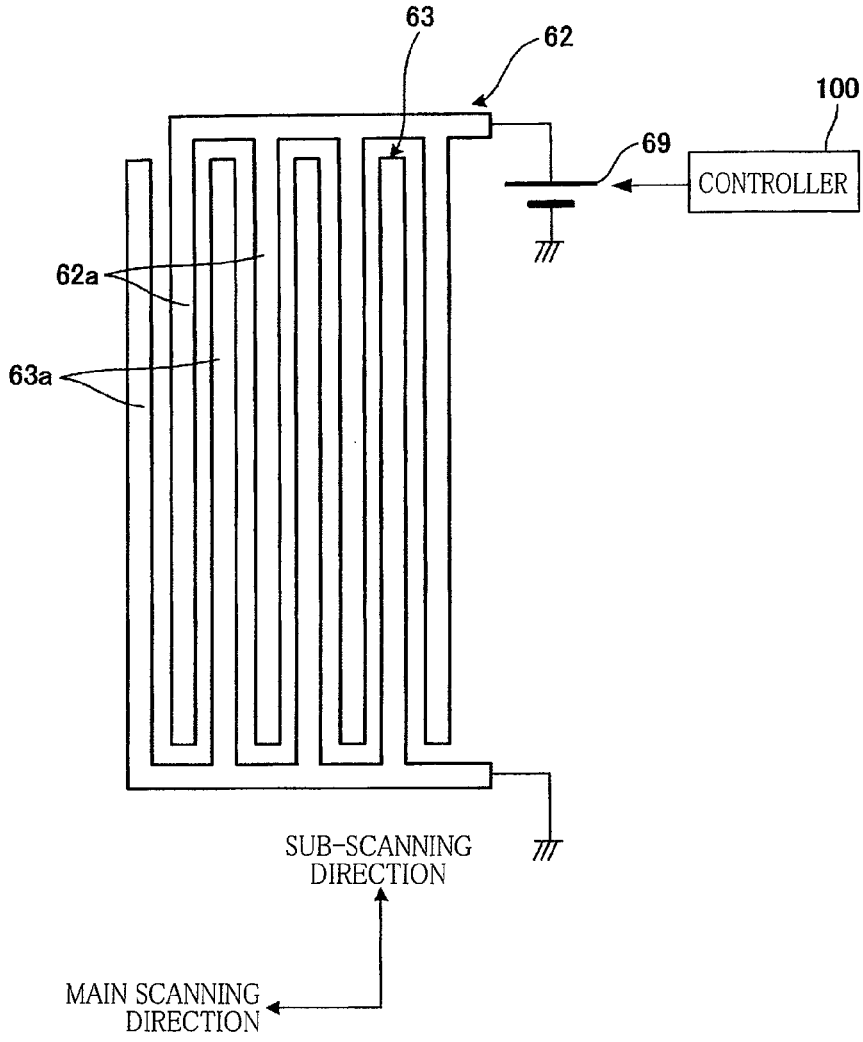
FIG. 3 is a schematic circuit diagram showing an electric construction of the adsorptive platen, the schematic circuit diagram including a plan view of electrodes in the adsorptive platen.
Figure 4:
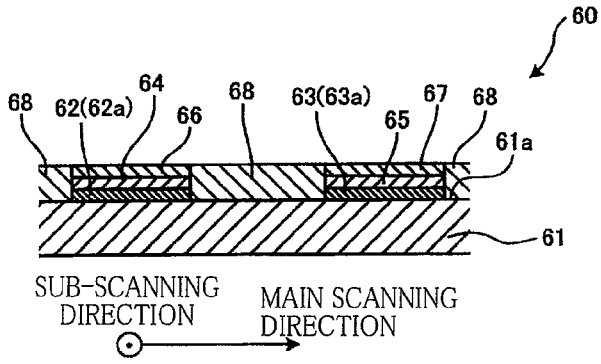
FIG. 4 is a partial enlarged view in cross section taken along line IV-IV in FIG. 2.

As shown in FIGS. 2 to 4, the adsorptive platen 60 includes a base member 61 having a plate shape and formed of an insulating material, and electrodes 62, 63 as a first and a second electrode bonded to an upper face 61*a* of the adsorptive platen 60. The electrodes 62, 63 respectively include a plurality of elongated portions 62*a*, 63*a* extending in the sheet feeding direction A. Each of the electrodes 62, 63 has a comb-like shape such that the elongated portions 62*a* and the elongated portions 63*a* are alternately arranged in the main scanning direction. An area at which the electrodes 62, 63 are formed has about the same width as the sheet P in the main scanning direction and extends or straddles, in the sub-scanning direction, an area at which the ink-jet heads 2 are disposed. The electrodes 62, 63 have respective upper faces formed horizontally at the same height. The electrode 62 is connected to a power source 69 provided in the casing 1*a*, and the electrode 63 is grounded. The power source 69 is controlled by the controller 100. A material having a good electric conductivity such as a metal is used for the electrodes 62, 63.

Surface layer members 64, 65 as a first and a second surface layer member are bonded to the respective upper faces of the electrodes 62, 63. An entire area of the upper face of the electrode 62 except for a connecting portion thereof connected to the power source 69 is covered with the surface layer member 64. An entire area of the upper face of the electrode 63 except for a connecting portion thereof connected to the power source 69 is covered with the surface layer member 65. The respective upper faces of the surface layer members 64, 65 are formed horizontally at the same height.

Each of the surface layer members 64, 65 is formed of, e.g., vinyl chloride and polypropylene and has a volume resistivity of about between 1010 and 1014 .OMEGA.-cm, the volume resistivity being relatively high in comparison with the electrodes 62, 63. As a result, it is prevented that an excessive current flows between the electrodes 62, 63 when a potential difference has been generated between the electrodes 62, 63. Further, since the surface layer members 64, 65 are provided, it is prevented that a short circuit is caused between the electrodes 62, 63 by contact of surfaces of the electrodes 62, 63 with other members. It is noted that any material may be used for each of the surface layer members 64, 65 as long as each of the surface layer members 64, 65 has the volume resistivity of about between 1010 and 1014 .OMEGA.-cm. Further, the volume resistivity of each of the surface layer members 64, 65 preferably fall within the above-described range but may not fall within the above-described range if the volume resistivity of each of the surface layer members 64, 65 is higher than that of each of the electrodes 62, 63. Further, in the present embodiment, the same material is used for the surface layer members 64, 65, but different materials may be used.

Low resistance members 66, 67 as a first and a second low resistance member are bonded and fixed to the respective upper faces of the surface layer members 64, 65. Further, the low resistance members 66, 67 are distant from each other in a horizontal direction, and each of intermediate members 68 is disposed at a position between adjacent two of the low resistance members 66, 67. The low resistance members 66, 67 and the intermediate members 68 will be described later.

A nip roller 4 is disposed at a position corresponding to an upstream end of the adsorptive platen 60 so as to face the elongated portions 62*a*, 63*a* of the electrodes 62, 63. The nip roller 4 presses the sheet P supplied the sheet-supply device 10 onto a sheet-placed face 54 of the sheet feeding belt 53.

In this configuration, the belt roller 52 is rotated in the clockwise direction in FIG. 1 by the control of the controller 100, thereby rotating the sheet feeding belt 53. In this operation, the belt roller 51 and the nip roller 4 are also rotated in accordance with the rotation of the sheet feeding belt 53. Further, in this operation, a positive potential is applied to the electrode 62 by the control of the controller 100, and a ground potential is applied to the electrode 63. It is noted that this ink-jet printer 1 may have any configuration as long as a potential difference is generated between the electrodes 62, 63. For example, a negative potential may be applied to the electrode 62, and a ground potential and a potential different from the ground potential may be respectively applied to the electrode 62 and the electrode 63.

Figure 5:
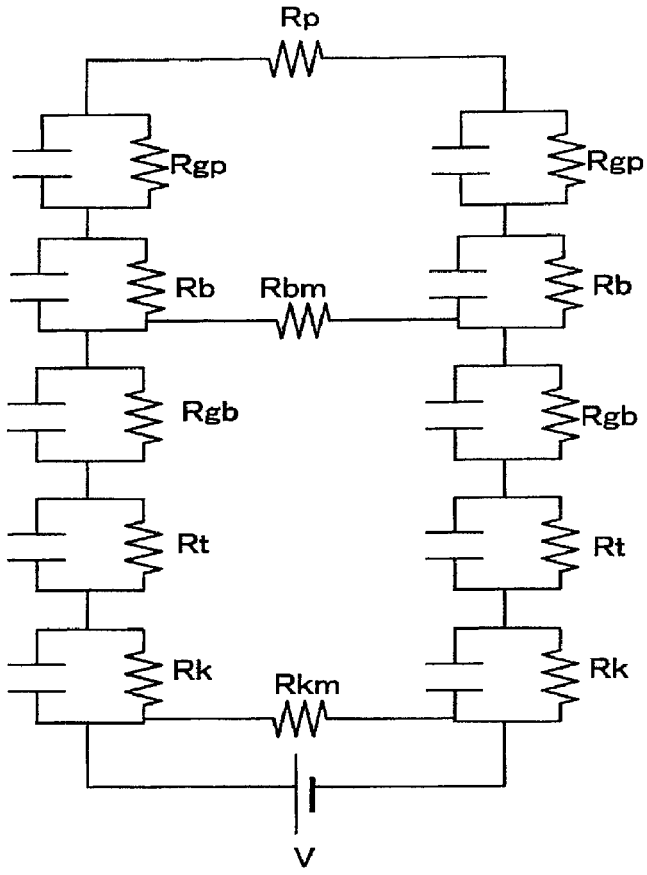
FIG. 5 is an electric circuit diagram showing an electric circuit formed by a recording medium, the adsorptive platen, and the sheet feeding mechanism.

When the potential difference has been generated between the electrodes 62, 63, the current flows between the electrodes 62, 63 via the sheet feeding belt 53 and the sheet P. FIG. 5 shows an electric circuit formed when a potential difference V has been generated between the electrodes 62, 63. It is noted that the electric circuit shown in FIG. 5 is merely one model which is assumed where the present embodiment is idealized as an electric construction.

This electric circuit includes a main path passing through the electrode 62, the sheet feeding belt 53, the sheet P, the sheet feeding belt 53, and the electrode 63 in order. Signs Rk, Rt, Rgb, Rb, Rgp, and Rp respectively denote electrical resistances of respective points in this main path. Specifically, the sign Rk corresponds to an electrical resistance of the surface layer member 64 (or the surface layer member 65). The sign Rt corresponds to an electrical resistance of the low resistance member 66 (or the low resistance member 67). The sign Rgb corresponds to a contact resistance between the low resistance member 66 (or the low resistance member 67) and the sheet feeding belt 53. The sign Rb corresponds to an electrical resistance of the sheet feeding belt 53. The sign Rgp corresponds to a contact resistance between the sheet feeding belt 53 and the sheet P. The sign Rp corresponds to an electrical resistance of the sheet P.

Further, this electric circuit includes alternative paths connected to the main path in parallel. Signs Rkm and Rbm respectively denote electrical resistances of the alternative paths. Specifically, the sign Rkm denotes an electrical resistance of an alternative path directly connecting the electrodes 62, 63 to each other via the intermediate members 68. The sign Rbm denotes an electrical resistance of an alternative path connecting a side of the electrode 62 and a side of the electrode 63 to each other not via the sheet P but via the sheet feeding belt 53. These alternative paths are paths of current flowing in a face direction of the sheet feeding belt 53 and the intermediate members 68. These paths respectively extend through the sheet feeding belt 53 and the intermediate members 68 each having a high electrical resistance. Thus, each of the resistances Rkm and Rbm is considerably high in comparison with a total of the resistances Rk, Rt, Rgb, Rb, Rgp, and Rp.

As shown in FIG. 5, a condenser connected to the electrical resistances in parallel is formed. Further, fine projections and recessions are formed on and in respective faces of the sheet P and the sheet feeding belt 53 which face each other. Thus, where the potential difference has been generated between the electrodes 62, 63, a minute current flows to spaces between the sheet P and the sheet feeding belt 53 at an area at which the sheet P and the sheet feeding belt 53 contact each other, whereby the potential difference is generated in these spaces. Further, electric charges having different polarities are accumulated on an area at which the sheet P and the sheet feeding belt 53 do not contact each other, so that an attractive force or an adsorptive force as a coulomb force acts on the sheet P and the sheet feeding belt 53. The sheet P on the sheet feeding belt 53 is electrostatically attracted to the sheet-placed face 54 by this attractive force called "Johnsen-Rahbeck force". It is noted that the sheet feeding belt 53 is formed of the material having a relatively high volume resistivity as described above for the following reason. That is, where the resistance of the sheet feeding belt 53 is low, the electrical resistance Rbm of the alternative path connecting the side of the electrode 62 and the side of the electrode 63 to each other via the sheet feeding belt 53 becomes low, so that the current is more likely to flow to the alternative path and less likely to flow to the sheet P. On the other hand, where the resistance of the sheet feeding belt 53 becomes excessively high, the current is less likely to flow from the sheet feeding belt 53 to the sheet P. Accordingly, in each of the cases where the resistance of the sheet feeding belt 53 is too low and too high, the attractive force by the "Johnsen-Rahbeck force" becomes small.

The sheet P supplied from the sheet-supply device 10 is fed in the sheet feeding direction A while being attracted and adsorbed to the sheet-placed face 54 by the attractive force generated by the adsorptive platen 60. In this operation, when the sheet P fed while being adsorbed onto the sheet-placed face 54 of the sheet feeding belt 53 passes through positions just under the four ink-jet heads 2 (i.e., areas facing ink-ejection faces 2*a* of the respective ink-jet heads 2) in order, the controller 100 controls the ink-jet heads 2 to eject the inks of respective colors toward the sheet P. As a result, a desired color image is formed on the sheet P.

As shown in FIG. 1, a peeling plate 9 is provided just on a downstream side of the sheet feeding mechanism 50 in the sub-scanning direction. The peeling plate 9 peels the sheet P from the sheet-placed face 54 by entering, at a distal end of the peeling plate 9, into a position between the sheet P and the sheet-feed belt 53.

Between the sheet-feed mechanism 50 and the sheet-discharge portion 15 along the sheet feeding path, there are disposed (a) four sheet-feed rollers 21*a*, 21*b*, 22*a*, 22*b* and (b) a sheet discharging guide 18 disposed between the sheet-feed rollers 21*a*, 21*b* and the sheet-feed rollers 22*a*, 22*b*. The sheet-feed rollers 21*b*, 22*b* are driven to be rotated by a sheet-feed motor, not shown, controlled by the controller 100. Further, the sheet-feed rollers 21*a*, 22*a* are driven rollers rotated with the feeding of the sheet P.

In this construction, the controller 100 controls the sheet-feed motor to be driven such that the sheet-feed rollers 21*b*, 22*b* are rotated, whereby the sheet P fed by the sheet-feed mechanism 50 is fed through the sheet discharging guide 18 toward an upper portion of the ink-jet printer 1 in FIG. 1 while being held by the sheet-feed rollers 21*a*, 21*b*. Then, the sheet P is discharged to the sheet-discharge portion 15 while being held by the sheet-feed rollers 22*a*, 22*b*.

In the present embodiment, the sheet P is adsorbed onto the sheet feeding belt 53 by the adsorptive platen 60 as explained above. However, the attractive force by the adsorptive platen 60 is also generated on areas other than the area between the sheet feeding belt 53 and the sheet P. For example, as indicated by the condenser connected in parallel to the electrical resistance Rgb in FIG. 5, the electric charges are accumulated in areas between the adsorptive platen 60 and the sheet feeding belt 53. Where the electric charges have been accumulated in the area between the adsorptive platen 60 and the sheet feeding belt 53, the sheet feeding belt 53 is adsorbed to the adsorptive platen 60, so that an electrostatic force and a frictional force acting on the areas between the sheet feeding belt 53 and the adsorptive platen 60 are made larger. This causes a problem that a sheet-feeding load of the sheet feeding belt 53 is increased.

In order to avoid or suppress the problem, the low resistance members 66, 67 are respectively stacked on the upper surfaces of the respective surface layer members 64, 65 in the present embodiment. An entire face of the surface layer member 64 is covered with the low resistance member 66, and an entire face of the surface layer member 65 is covered with the low resistance member 67. The upper faces of the respective low resistance members 66, 67 are formed horizontally at the same height. Each of the low resistance members 66, 67 is formed of a material having a good electric conductivity such as a metal. Each of the low resistance members 66, 67 is preferable with a low volume resistivity, but any material may be used for the low resistance members 66, 67 as long as the volume resistivity of each of the low resistance members 66, 67 is lower than that of each of the surface layer members 64, 65 (of course, the volume resistivity of each of the low resistance members 66, 67 is lower than that of the endless sheet feeding belt 53). In the present embodiment, since each of the surface layer members 64, 65 has the volume resistivity of about between 1010 and 1014 Ω-cm as described above, the volume resistivity of each of the low resistance members 66, 67 may be adjusted to a value up to about 1010 Ω-cm, but it has been found that a prominent effect is obtained where the volume resistivity is set at about 108 Ω-cm in a certain example.

Where the low resistance members 66, 67 each having the low volume resistivity are provided between the respective surface layer members 64, 65 and the sheet feeding belt 53 as described above, an amount of the electric charges accumulated in the area between the sheet feeding belt 53 and the adsorptive platen 60 is decreased, whereby the attractive force is less likely to be generated in the space. This is for the following reason. Since each of the resistances Rbm, Rkm of the alternative paths is considerably high in comparison with the resistances of the main path, the circuit in FIG. 5 can be considered to be generally equivalent to a circuit constituted by only the main path. Accordingly, the circuit in FIG. 5 can be considered as a circuit in which the resistances are connected in series, and a resistance value of an entire circuit is written as "2×(Rk+Rt+Rgb+Rb+Rgp)+Rp". Further, a voltage Vgb applied to a space between the sheet feeding belt 53 and the adsorptive platen 60 is written as "Vgb=V×Rgb/{2×(Rk+Rt+Rgb+Rb+Rgp)+Rp}".

Here, the case where the low resistance members 66, 67 are provided on the circuit and the case where the low resistance members 66, 67 are not provided on the circuit are compared with each other. Where the low resistance members 66, 67 are provided on the circuit, the resistance value of the entire circuit is the value described above. On the other hand, where the low resistance members 66, 67 are not provided on the circuit, the resistance value of the entire circuit is written as "2×(Rk+Rgb'+Rb+Rgp). Here, Rgb' denotes a contact resistance between (a) the respective surface layer members 64, 65 and (b) the sheet feeding belt 53. When comparing the above-described two expressions, where the low resistance members 66, 67 are provided on the circuit, the resistance value is large by the value obtained by "2×Rt". Further, since the electrical resistance Rt of the low resistance member is lower than the electrical resistance Rk of the surface layer member, the resistance Rgb is lower than the resistance Rgb' (Rgb<Rgb'), and thus the value "2×Rgb" is smaller than the value "2×Rgb'". Accordingly, a high-and-low relationship of the above-described two expressions can be obtained.

However, the resistance Rt is considerably low when in comparison with each of the resistances Rk, Rb, Rp. For example, the volume resistivity of each of the surface layer members 64, 65 is equal to or greater than 1010 Ω-cm as described above while the volume resistivity of each of the low resistance members 66, 67 is equal to or less than 1 Ω-cm. Further, the resistance Rgb is originally very low in comparison with each of the resistances Rk, Rb, Rp. Thus, even where the resistance is decreased from the resistance Rgb' to the resistance Rgb, an effect given to the resistance value of the entire circuit in FIG. 5 is extremely small. Thus, change in the resistance value of the entire circuit in FIG. 5 is extremely small when comparing the case where the low resistance members 66, 67 are provided with the case where the low resistance members 66, 67 are not provided.

Accordingly, a value of "2×(Rk+Rt+Rgb+Rb+Rgp)+Rp" in denominator of the above-described expression representing the voltage Vgb is not changed in the case where the low resistance members 66, 67 are provided and in the case where the low resistance members 66, 67 are not provided. However, since the Rgb in numerator is decreased to Rgb, the voltage Vgb is lowered in its entirety in the case where the low resistance members 66, 67 are provided on the circuit in comparison with the case where the low resistance members 66, 67 are not provided on the circuit. An electric charge Q accumulated between the sheet feeding belt 53 and the adsorptive platen 60 is obtained by multiplication between (a) a capacitance C between the sheet feeding belt 53 and the adsorptive platen 60 and (b) the voltage Vgb applied to the sheet feeding belt 53 and the adsorptive platen 60. That is, the electric charge Q is written as "Q=C×Vgb". Here, the capacitance C is constant regardless of the presence or absence of the low resistance members 66, 67 since the capacitance C is determined by a property of air existing between the sheet feeding belt 53 and the adsorptive platen 60. Thus, in the case where the low resistance members 66, 67 are provided, the electric charge Q is decreased in accordance with the lowering of the voltage Vgb in comparison with the case where the low resistance members 66, 67 are not provided. As a result, the attractive force generated between the sheet feeding belt 53 and the adsorptive platen 60 is made smaller.

In contrast, the attractive force generated between the sheet P and the sheet feeding belt 53 is little changed even in the case where the low resistance members 66, 67 are provided in comparison with the case where the low resistance members 66, 67 are not provided. This is for the following reason. As described above, where the low resistance members 66, 67 are provided, the resistance value of the entire circuit in FIG. 5 is written as "2×(Rk+Rt+Rgb+Rb+Rgp)+Rp". The voltage Vgp applied to the space between the sheet feeding belt 53 and the sheet P is written as "Vgp=V×Rgp/{2×(Rk+Rt+Rgb+Rb+Rgp)+Rp}".

As described above, in the case where the low resistance members 66, 67 are provided, the resistance value of the entire circuit in FIG. 5 is not greatly changed in comparison with the case where the low resistance members 66, 67 are not provided. Since the resistance value Rgp of the space between the sheet feeding belt 53 and the sheet P is not changed depending upon the presence or absence of the low resistance members 66, 67, the voltage Vgp is not changed as apparent from the above-described expression of the voltage Vgp, and accordingly the electric charge Q (Q=C×Vgp) accommodated between the sheet P and the sheet feeding belt 53 is not changed either. Thus, the attractive force generated between the sheet P and the sheet feeding belt 53 is not changed.

Meanwhile, if the low resistance members 66, 67 are further provided on the respective surface layer members 64, 65, a difference in height between the upper face 61*a* of the base member 61 and the upper faces of the low resistance members 66, 67 increases, so that projections and recessions are formed on and in the upper face of the adsorptive platen 60. In this case, there is a risk that the sheet feeding belt 53 is not smoothly rotated by getting snagged or caught on the projections and recessions formed on and in the upper face of the adsorptive platen 60.

In contrast, in the present embodiment, each of the intermediate members 68 is provided between the corresponding low resistance members 66, 67 in the main scanning direction. The upper face of the intermediate member 68 is formed so as to expand in the horizontal direction and disposed at the same height as the upper faces of the low resistance members 66, 67. As a result, respective surfaces of the intermediate member 68 and the low resistance members 66, 67 on a side of the sheet feeding belt 53 (i.e., the upper faces of the intermediate member 68 and the low resistance members 66, 67) are arranged along a horizontal plane. In other words, the respective upper surfaces of the intermediate member 68 and the low resistance members 66, 67 are flush with one another. Further, the intermediate member 68 is disposed so as not to form a space between the low resistance members 66, 67 in the main scanning direction. In order to prevent the short circuit from occurring between the low resistance members 66, 67 and between the electrodes 62, 63, a material having a higher volume resistivity is preferably used for the intermediate member 68. Specifically, a material having insulation properties such as a resin material is preferably used for the intermediate member 68. Providing the intermediate member 68 prevents the recesses from being formed between the low resistance members 66, 67 and improves a flatness of the upper face of the adsorptive platen 60. As a result, the sheet feeding belt 53 is rotated smoothly. Further, in order to prevent frictional charges generated between the intermediate member 68 and the sheet feeding belt 53, the intermediate member 68 is preferably formed of a material the same as that of the sheet feeding belt 53 or a material whose electrification series (electric similarity) is close to that of the sheet feeding belt 53.

It is noted that the upper faces of the electrodes 62, 63 are located at the same height. Likewise, the upper faces of the surface layer members 64, 65 are located at the same height, and the upper faces of the low resistance members 66, 67 are located at the same height. However, there may be a small amount of a displacement between each pair. In this case, the intermediate member 68 needs to be disposed so as to reduce or remove a recess between the low resistance members 66, 67.

Figure 6:
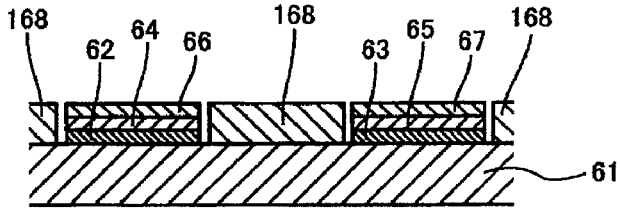
FIG. 6 is a cross-sectional enlarged view showing a modification of the adsorptive platen shown in FIG. 4.

Further, each intermediate member 68 is disposed so as not to form the space between the corresponding low resistance members 66, 67 in the main scanning direction but instead of the intermediate members 68 explained above, the ink-jet printer 1 may include intermediate members 168 shown in FIG. 6 each disposed so as to form spaces between the low resistance members 66, 67 in the main scanning direction. Further, each intermediate member 168 is also distant from adjacent two of the electrodes 62, 63. In this configuration, since short circuits are not caused between the low resistance members 66, 67 and between the electrodes 62, 63, the intermediate member 168 may be formed of a material having electrical conductivity in some degree such as a semiconducting sheet.

In the present embodiment, the electrode 62, the surface layer member 64, and the low resistance member 66 have the same planar shape and almost completely overlap with one another, and the electrode 63, the surface layer member 65, and the low resistance member 67 also have the same planar shape and almost completely overlap with one another. Thus, these members are easily formed by punching or stamping upon manufacturing these members. For example, a sheet member constituting the electrodes 62, 63, a sheet member constituting the surface layer members 64, 65, and a sheet member constituting the low resistance members 66, 67 are stacked in order, and then a stacked body of the sheet members thus obtained is punched in a direction in which the sheet members are stacked on one another, such that the planar shape of the electrodes 62, 63 is formed, thereby easily forming the electrodes 62, 63, the surface layer members 64, 65, and the low resistance members 66, 67.

Second Embodiment

Figure 7B:
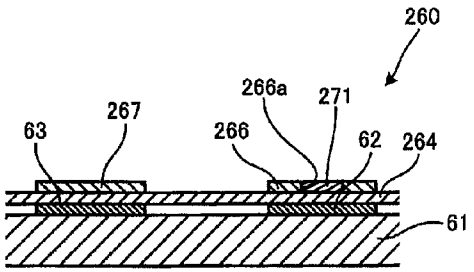
FIG. 7B is a partial enlarged view in cross section taken along line B-B in FIG. 7A.
Figure 7A:
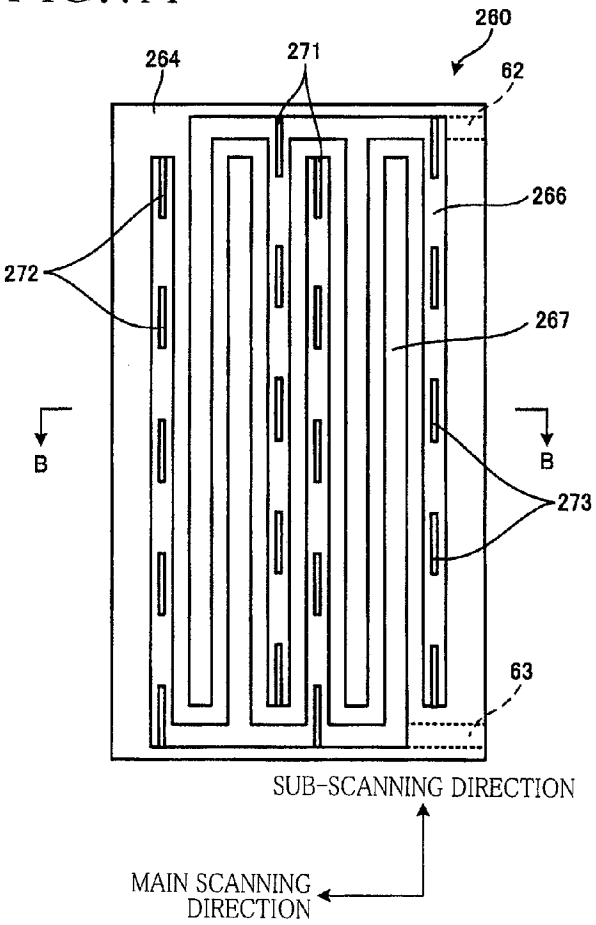
FIG. 7A is a plan view showing an adsorptive platen in a second embodiment of the present invention.

Hereinafter, there will be explained a second embodiment of the present invention with reference to FIGS. 7A and 7B. The second embodiment is different from the first embodiment only in a construction of the adsorptive platen, and an explanation of the other constructions are dispensed with. Further, also in the adsorptive platen, the same reference numerals are used to designate corresponding members in this second embodiment, and an explanation of which is dispensed with.

An adsorptive platen 260 in the second embodiment includes the base member 61 and the electrodes 62, 63 bonded on the upper face of the base member 61 as in the first embodiment. A surface layer member 264 is stacked on the upper faces of the electrodes 62, 63. The surface layer member 264 is formed as one member over an entire area of the upper face of the base member 61. Low resistance members 266, 267 are stacked on an upper face of the surface layer member 264. The low resistance member 266 has a planar shape so as to almost completely overlap with the electrode 62, and the low resistance member 267 has a planar shape so as to almost completely overlap with the electrode 63.

A plurality of penetrating areas 266*a* as through-hole areas are formed through the low resistance member 266 in a thickness direction thereof. That is, the penetrating areas 266*a* function as resistance-member unformed areas in which no low resistance members are disposed between the electrode 62 and the sheet feeding belt 53. These penetrating areas 266*a* are filled with high resistance members 271 or 273. The high resistance members 271 and 273 are formed of a material having a higher volume resistivity than the material forming the low resistance members 266, 267. The high resistance members 271 (i.e., the penetrating areas 266*a* in which the same 271 are packed) are disposed at a central portion of the adsorptive platen 260 in the main scanning direction, and the high resistance members 273 (i.e., the penetrating areas 266*a* in which the same 271 are packed) are disposed at an end portion of the adsorptive platen 260 in the main scanning direction.

Likewise, a plurality of penetrating areas are formed through the low resistance member 267 in a thickness direction thereof, thereby forming no-resistance-member areas in which no low resistance members are disposed between the electrode 62 and the sheet feeding belt 53. These penetrating areas are filled with the high resistance members 271 or high resistance members 272. The high resistance members 271 and 272 are formed of a material having a higher volume resistivity than the material forming the low resistance members 266, 267. The high resistance members 271 are disposed at a central portion of the adsorptive platen 260 in the main scanning direction, and the high resistance members 272 are disposed at an end portion of the adsorptive platen 260 in the main scanning direction.

In this second embodiment, since the low resistance members 266, 267 are provided like the first embodiment, the attractive force generated between the sheet feeding belt 53 and the adsorptive platen 260 is small in comparison with the case where the low resistance members 266, 267 are not provided. On the other hand, neither the low resistance member 266 nor 267 is not disposed on the areas at which the high resistance members 271 to 273 are provided. Thus, on the areas at which the high resistance members 271 to 273 are provided, the electric charges are more likely to be accumulated and accordingly the attractive force is more likely to be generated in comparison with the areas at which the low resistance members 266, 267 are provided. Thus, the sheet-feeding load of the sheet feeding belt 53 is suppressed in its entirety, but the attractive force is generated at the areas at which the high resistance members 271 to 273 are disposed, thereby attracting the sheet feeding belt 53 to the adsorptive platen 260. As a result, it is possible to prevent the sheet feeding belt 53 from floating in a direction away from the adsorptive platen 260.

Here, since the high resistance members 271 are disposed at the central portion of the adsorptive platen 260 in the main scanning direction, the high resistance members 271 are opposed to a central portion of the sheet feeding belt 53 in the main scanning direction. Thus, the central portion of the sheet feeding belt 53 is attracted to the adsorptive platen 260, thereby restraining the floating of the sheet feeding belt 53 in a balanced manner. Further, since the high resistance members 272, 273 are disposed at the opposite end portions of the adsorptive platen 260 in the main scanning direction, the high resistance members 272, 273 are respectively opposed to opposite end portions of the sheet feeding belt 53 in the main scanning direction. Thus, the opposite end portions of the sheet feeding belt 53 are attracted to the adsorptive platen 260, thereby also restraining the floating of the sheet feeding belt 53 in a balanced manner. As thus described, the high resistance members are preferably arranged so as to be symmetrical about a center of the adsorptive platen 260 in the main scanning direction.

In the present embodiment, since the surface layer member 264 is formed so as to be spread on or straddle the components such as the electrode 62 and the low resistance member 266 in the horizontal direction, these components cannot be formed at the same time by punching. Thus, the low resistance member 266, 267 are preferably formed by stacking the surface layer member 264 on the electrodes 62, 63 and then bonding the sheet member constituting the low resistance member 266, 267 to the upper face of the surface layer member 264 or providing an electrically conductive coating treatment on the upper face of the surface layer member 264.

Figure 8:
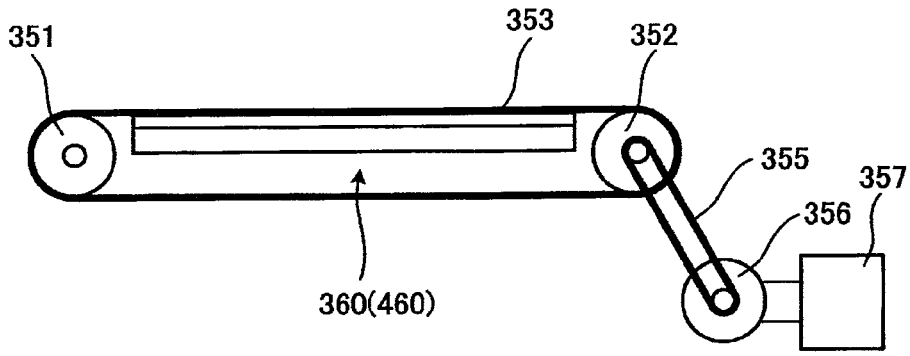
FIG. 8 is a schematic view showing a construction of an example of the above-described embodiment.

Hereinafter, there will be explained an example constructed on the basis of the above-described embodiment. FIG. 8 is the schematic view showing a construction of the present example. The present example includes belt rollers 351, 352, a sheet feeding belt 353, and an adsorptive platen 360 respectively corresponding to the belt rollers 51, 52, the sheet feeding belt 53, and the adsorptive platen 60 in the above-described embodiment. Further, a drive belt 355 is wound around a rotational shaft of the belt roller 352. The drive belt 355 is also wound around a drive shaft of a drive motor 356 at a position located on an opposite side of the belt roller 352. To the drive motor 356 is connected a load measuring device 357 configured to measure a load of the drive motor 356. When the drive motor 356 is driven, a drive force thereof is transmitted to the belt roller 352 via the drive belt 355, whereby the belt roller 352 is rotated. The sheet feeding belt 353 is rotated in accordance with the rotation of the belt roller 352. The load measuring device 357 measures the load of the drive motor 356 at the time of this rotation. Thus, a measurement value of this measurement represents a sheet-feeding load of the sheet feeding belt 353.

Figure 9A:
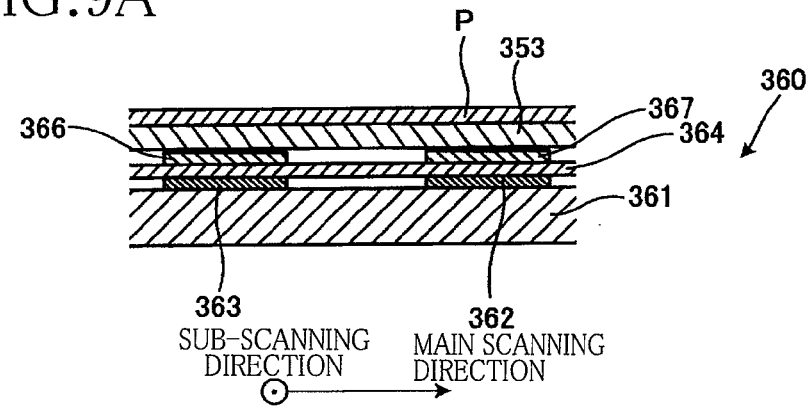
FIG. 9A is an elevational view in vertical cross section showing an adsorptive platen in the example of the above-described embodiment.
Figure 9B:
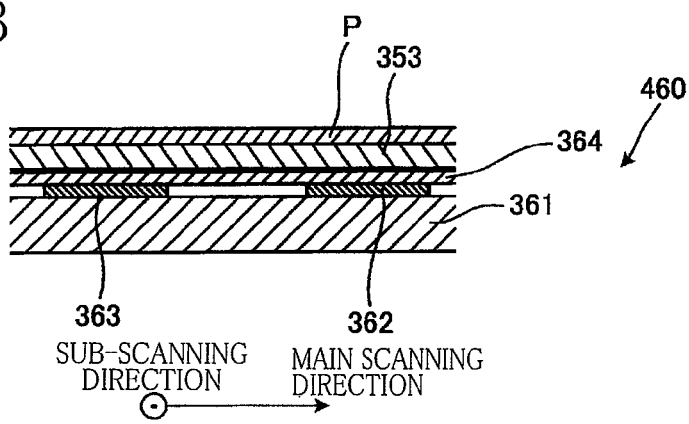
FIG. 9B is an elevational view in vertical cross section showing a construction of a comparative example to the example of the above-described embodiment.

FIG. 9A is the elevational view in vertical cross section showing the adsorptive platen 360 in the present example. The adsorptive platen 360 includes a base member 361, electrodes 362, 363, a surface layer member 364, and low resistance members 366, 367 respectively corresponding to the base member 61, the electrodes 62, 63, the surface layer member 264, and the low resistance members 66, 67 in the above-described embodiment. In the present example, the surface layer member 364 is formed over an entire area of an upper face of the base member 361 like the surface layer member 264 in the second embodiment. FIG. 9B is the elevational view in vertical cross section showing a construction of a comparative example to the present example. An adsorptive platen 460 in this comparative example is constructed by excluding the low resistance members 366, 367 from the construction of the present example and configured such that the surface layer member 364 is opposed to an inner face of the sheet feeding belt 353 instead of the low resistance members 366, 367. It is noted that the penetrating areas 266*a* formed in the low resistance member 266 in the second embodiment are not formed in the low resistance members 366, 367 in the present example, and accordingly no high resistance members are provided in the low resistance members 366, 367.

The inventors have conducted an experiment for examining effects regarding a sheet-feeding load of the sheet feeding belt 353. The experiment has been conducted on an example 1 and an example 2 of the present example in which materials for forming the respective low resistance members 366, 367 are different from each other. In this experiment, a sheet formed of polyvinylidene fluoride is used for the surface layer member 364, and a thickness thereof is set at 0.1 mm and a volume resistivity thereof is set at 1012 Ω-cm. Polyimide is used for the sheet feeding belt 353, and a thickness thereof is set at 0.09 mm and a volume resistivity thereof is set at 1011 Ω-cm. An A4-size plain paper is used for the sheet P. The low resistance members 366, 367 are set to have generally the same thickness of about 0.1 mm. The following Table 1 shows materials used for the low resistance members 366, 367 in the examples 1, 2 and their properties. It is noted that, in Table 1, a frictional coefficient in the comparative example is a value for determining a frictional force acted between the surface layer member 364 and the sheet feeding belt 353, and frictional coefficients in the examples 1, 2 are values for determining a frictional force acted between the low resistance members 366, 367 and the sheet feeding belt 353. An "ETFE" represents an ethylene-tetrafluoroethylene copolymer.

TABLE 1

| | LOW RESISTANCE MEMBER | | |
|---|---|---|---|
| | MATERIAL | VOLUME RESISTIVITY | FRICTIONAL COEFFICIENT |
| COMPARATIVE EXAMPLE | — | — | (0.26) |
| EXAMPLE 1 | ETFE | $10^8$ Ω-cm | 0.34 |
| EXAMPLE 2 | COPPER FILM | 0 Ω-cm | 0.27 |

Table 2 represents a result of measurement of a load acting on the sheet feeding belt 353 which measurement is performed by the load measuring device 357 when the sheet feeding belt 353 has been driven by the drive motor 356 while the sheet P is adsorbed by applying the voltage to the electrodes 362, 363 on the above-described conditions. A voltage of 3 kV has been applied to the electrodes 362, 363. A "PERSENTAGE" in Table 2 represents a percentage representing the sheet-feeding loads in the examples 1, 2 and the comparative example where the sheet-feeding load in the comparative example is defined as 100%.

As shown in Table 2, the loads in the examples 1, 2 are significantly smaller than in that in the comparative example. For example, the sheet-feeding loads in the examples 1, 2 are significantly smaller than in that in the comparative example though, as shown in Table 1, the frictional coefficients in the examples 1, 2 are larger than or generally equal to that in the comparative example. This is probably because the low resistance members 366, 367 are provided in the examples 1, 2 unlike in the comparative example. Further, though the frictional coefficient in the example 2 is smaller than that in the example 1, a value obtained by dividing the sheet-feeding load in the example 2 by the sheet-feeding load in the example 1 (i.e., 0.11/0.19) is smaller than a value obtained by dividing the frictional coefficient in the example 2 by the frictional coefficient in the example 1 (i.e., 0.27/0.34). That is, the sheet-feeding load is reduced by an amount larger than an amount by which the sheet-feeding load is reduced where it is assumed that the sheet-feeding load is simply proportional only to the frictional coefficient. This is probably because the volume resistivity of the low resistance members 366, 367 is lower in the example 2 than in the example 1, and accordingly the attractive force between the sheet feeding belt 353 and the adsorptive platen 360 is smaller in the example 2 than in the example 1.

TABLE 2

| | SHEET-FEEDING LOAD | PERCENTAGE |
|---|---|---|
| COMPARATIVE EXAMPLE | 0.41 N-m | 100% |
| EXAMPLE 1 | 0.19 N-m | 46% |
| EXAMPLE 2 | 0.11 N-m | 27% |

Then, a voltage applied to the electrodes 362, 363 has been measured, the voltage being required for the adsorption of the sheet P to the sheet feeding belt 353. In this measurement, a sheet P of postcard size to which about 10 mm curl has been given is placed on an outer face of the sheet feeding belt 353. Then, the voltage applied to the electrodes 362, 363 has been gradually increased, and the voltage required for adsorption of an entire face of the sheet P has been measured. Table 3 shows a result of this measurement. A symbol "○" in Table 3 represents a case where the entire face of the sheet P has been adsorbed, and a symbol "x" represents a case where the entire face of the sheet P has not been adsorbed. As shown in Table 3, the voltage required for the adsorption of the entire face of the sheet P is 3 kV in each of the comparative example and the examples 1, 2.

TABLE 3

| | APPLIED VOLTAGE | | |
|---|---|---|---|
| | 2 kV | 3 kV | 4 kV |
| COMPARATIVE EXAMPLE | x | ○ | ○ |
| EXAMPLE 1 | x | ○ | ○ |
| EXAMPLE 2 | x | ○ | ○ |

In the above-described experiment, the inventors have observed that only the attractive force between the sheet feeding belt 353 and the adsorptive platen 360 can be reduced by a larger amount in each of the examples 1, 2 than in the comparative example without reducing the attractive force of the sheet P.

Other Modifications

While the embodiments of the present invention have been described above, it is to be understood that the invention is not limited to the details of the illustrated embodiments, but may be embodied with various changes and modifications, which may occur to those skilled in the art, without departing from the spirit and scope of the invention.

Figure 10:
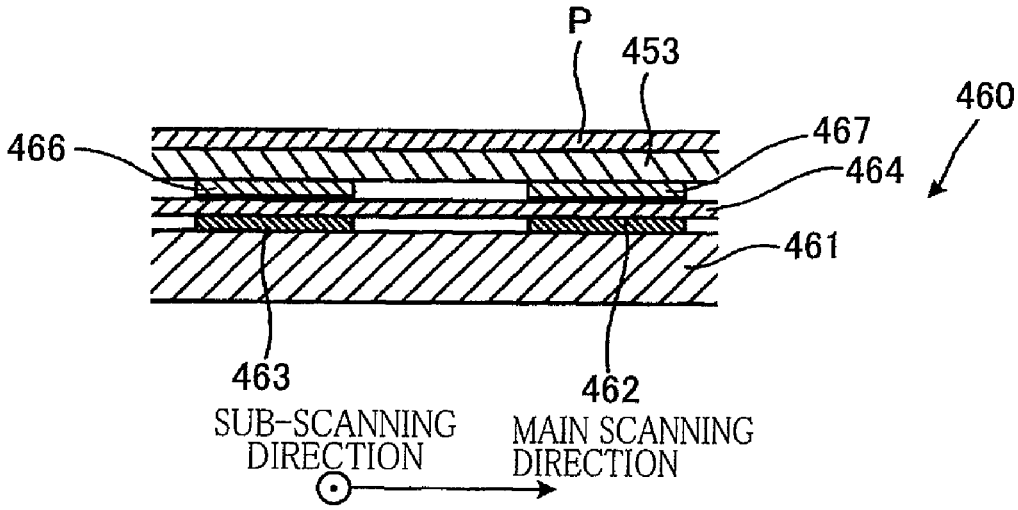
FIG. 10 is an elevational view in vertical cross section showing an adsorptive platen as a modification of the example of the above-described embodiment.

For example, in each of the first and second embodiments, the low resistance member is directly stacked on the surface layer member, thereby facilitating formation of the low resistance member on the surface layer member in a manufacturing process. However, as shown in FIG. 10, low resistance members 466, 467 may be fixed on one of opposite faces of a sheet feeding belt 453 which one faces the adsorptive platen 460. The adsorptive platen 460 shown in FIG. 10 includes a base member 461 and electrodes 462, 463 bonded on an upper face of the base member 461. A surface layer member 464 is stacked on upper faces of the electrodes 462, 463. The surface layer member 464 is formed as one member over an entire area of the upper face of the base member 461. The low resistance members 466, 467 are bonded on one of opposite faces of the sheet feeding belt 453 which one is opposed to the other face thereof on which the sheet P is placed, i.e., one of the opposite faces of the sheet feeding belt 453 which one faces the adsorptive platen 460. In this adsorptive platen 460, the electrical resistance Rt of the low resistance members 466, 467 is lower than the electrical resistance Rb of the sheet feeding belt 453. Thus, when comparing with a contact resistance between the surface layer member 464 and the sheet feeding belt 453 in a case where the low resistance members 466, 467 are not provided, a contact resistance between the surface layer member 464 and the low resistance members 466, 467 in a case where the low resistance members 466, 467 are provided is low, thereby suppressing the attractive force generated between the surface layer member 464 and the low resistance members 466, 467. As a result, a movement resistance of the sheet feeding belt 453 is lowered. Hereinafter, a reason of this will be explained.

In the case where the low resistance members 466, 467 are fixed on the face of the sheet feeding belt 453 which faces the adsorptive platen 460, a resistance value between the surface layer member 464 and the sheet feeding belt 453 is increased by the resistance value Rt in comparison with a case where the low resistance members 466, 467 are not fixed on the face of the sheet feeding belt 453. In this adsorptive platen 460, a member contacting the surface layer member 464 is changed from the sheet feeding belt 453 to the low resistance members 466, 467. However, since the electrical resistance Rt of the low resistance members 466, 467 is lower than the electrical resistance Rb of the sheet feeding belt 453, the contact resistance Rgb between the surface layer member 464 and the low resistance members 466, 467 is lowered.

The resistance Rt is considerably low in comparison with the resistances Rk, Rb, Rp. For example, the volume resistivity of the surface layer members 464, 465 is equal to or greater than 1010 Ω-cm as described above, but the volume resistivity of the low resistance members 466, 467 is equal to or less than 1 Ω-cm. Further, the resistance Rgb is originally very low in comparison with the resistances Rk, Rb, Rp. Thus, even where the resistance Rgb is lowered, an effect given to the resistance value of the entire circuit in FIG. 5 is extremely small. Thus, change in the resistance value of the entire circuit in FIG. 5 is extremely small when comparing the case where the low resistance members 466, 467 are provided with the case where the low resistance members 466, 467 are not provided.

Accordingly, in the expression representing the voltage Vgb "$Vgb=V\times Rgb/\{2\times(Rk+Rgb+Rt+Rb+Rgp)+Rp\}$", a value of "$2\times(Rk+Rgb+Rt+Rb+Rgp)+Rp$" in denominator thereof is little changed between the case where the low resistance members 466, 467 are provided and the case where the low resistance members 466, 467 are not provided. However, since the resistance "Rgb" in numerator is lowered, the voltage Vgb is lowered in its entirety. An electric charge Q accumulated between the sheet feeding belt 453 (i.e., the low resistance members 466, 467) and the adsorptive platen 460 (i.e., the surface layer member 464) is obtained by multiplication between (a) a capacitance C between the sheet feeding belt 453 and the adsorptive platen 460 and (b) the voltage Vgb applied to the sheet feeding belt 453 and the adsorptive platen 460. That is, the electric charge Q is written as "$Q=C\times Vgb$". Here, the capacitance C is constant regardless of the presence or absence of the low resistance members 466, 467 since the capacitance C is determined by a property of air existing between the sheet feeding belt 453 and the adsorptive platen 460. Thus, in the case where the low resistance members 466, 467 are provided, the electric charge Q is decreased in accordance with the lowering of the voltage Vgb in comparison with the case where the low resistance members 466, 467 are not provided. As a result, the attractive force generated between the sheet feeding belt 453 (i.e., the low resistance members 466, 467) and the adsorptive platen 460 (i.e., the surface layer member 464) is made smaller.

In contrast, the attractive force generated between the sheet P and the sheet feeding belt 453 is little changed even in the case where the low resistance members 466, 467 are provided in comparison with the case where the low resistance members 466, 467 are not provided. This is for the same reason as in the above-described first embodiment. In short, the low resistance members 466, 467 only need to be disposed at a position between the surface layer member 464 or 465 and the sheet feeding belt 453.

Further, in the above-described first and second embodiments, the low resistance member has the planar shape almost completely overlapping with the electrode 62 or 63. However, the low resistance member may not have the same shape as the electrodes 62, 63. For example, a width of the low resistance member 66 in the main scanning direction may be longer or shorter than a width of the elongated portions 62*a* of the electrode 62. In any configuration, the width of each of the low resistance members 66, 67 is preferably adjusted with respect to a width of a corresponding one of the electrodes 62, 63 such that an amount of the attractive force of the sheet P and a feeding condition of the sheet feeding belt 53, etc., fall within an appropriate range.

Further, in the above-described second embodiment, the penetrating areas of the low resistance members 266, 267 are filled with the high resistance members, but no high resistance members may be filled with the penetrating areas, that is, the penetrating areas may be empty. Also in this configuration, the electric charges are more likely to be accumulated on areas of the surface layer member which correspond to the penetrating areas, in comparison with areas of the surface layer member on which the low resistance members 266, 267 are disposed, thereby suppressing the floating of the sheet feeding belt 53.

Further, the constructions in the above-described first and second embodiments may be combined with each other. For example, the penetrating areas may be formed in the low resistance members 66, 67 in the first embodiment and filled with the high resistance members. Further, the intermediate member may be disposed between the low resistance members 266, 267 in the second embodiment. Where the intermediate member is disposed in this manner, a flatness of the upper face of the adsorptive platen 260 is improved.

Further, in the above-described embodiments, the sheet P is adsorbed onto the sheet-placed face of the endless sheet feeding belt 53, and then the sheet feeding belt 53 is rotated, thereby feeding the sheet P. However, the sheet P may be fed in a manner different from this feeding manner. For example, the sheet P may be fed in a manner in which a feeding member configured to be reciprocated in the sub-scanning direction is provided, and the feeding member is reciprocated in a state in which the sheet P is adsorbed thereon. In this construction, the adsorptive platen 60 is disposed on an opposite side of a face of the feeding member on which the sheet P is placed.

Further, the above-described embodiments are examples of the application of the present invention to the ink-jet head configured to eject the ink from nozzles, but the present invention may be applied to ink-jet heads of other types. For example, the present invention is applicable to liquid-ejection heads of various types including: a liquid-ejection head configured to eject conductive paste to form a fine wiring pattern on a circuit board; a liquid-ejection head configured to eject organic illuminant on a circuit board to form a high-definition display; and a liquid-ejection head configured to eject optical resin on a circuit board to form a fine electronic device such as a light guide. Further, the present invention may be applied to a recording head of another type such as a thermal type.

What is claimed is:

1. A medium feeding apparatus comprising:

a feeding mechanism including a feeding member having a medium-placed face on which a recording medium is placed, the feeding mechanism being configured to feed the recording medium placed on the medium-placed face of the feeding member by moving the feeding member along a predetermined path;

an adsorbing unit including a first electrode and a second electrode each having a face facing a back face of the feeding member which back face is a face on the opposite side of the medium-placed face, the adsorbing unit being configured to adsorb the recording medium located on the medium-placed face to the medium-placed face by generating a potential difference between the first electrode and the second electrode;

a first surface layer member formed of a material having a higher volume resistivity than the first electrode and stacked on one of opposite faces of the first electrode which one is nearer to the back face of the feeding member than the other of the opposite faces thereof;

a second surface layer member formed of a material having a higher volume resistivity than the second electrode and stacked on one of opposite faces of the second electrode which one is nearer to the back face of the feeding member than the other of the opposite faces thereof;

a first low resistance member formed of a material having a lower volume resistivity than the first surface layer member and fixed, at a position between the first surface layer member and the feeding member, to one of faces of the first surface layer member which one faces the back face of the feeding member; and a second low resistance member formed of a material having a lower volume resistivity than the second surface layer member and fixed, at a position between the second surface layer member and the feeding member, to one of faces of the second surface layer member which one faces the back face of the feeding member, wherein the first low resistance member and the second low resistance member are disposed so as to be distant from each other.

2. The medium feeding apparatus according to claim 1, further comprising an intermediate member provided at a position between the first low resistance member and the second low resistance member, wherein the first low resistance member, the second low resistance member, and the intermediate member are disposed such that the face of the first low resistance member which faces the back face of the feeding member, the face of the second low resistance member which faces the back face of the feeding member, and one of opposite faces of the intermediate member which one faces the back face of the feeding member are in one plane.

3. The medium feeding apparatus according to claim 1, wherein at least one penetrating area as at least one unformed area that is an area in which neither the first low resistance member nor the second low resistance member is formed is formed through at least one of the first low resistance member and the second low resistance member in a thickness direction thereof.

4. The medium feeding apparatus according to claim 3, wherein a high resistance member formed of a material having a higher volume resistivity than any of the first low resistance member and the second low resistance member is disposed in the at least one penetrating area.

5. The medium feeding apparatus according to claim 3, wherein the at least one penetrating area is a plurality of penetrating areas, and wherein the plurality of penetrating areas are formed at positions which are located on the first low resistance member and the second low resistance member and at which the plurality of penetrating areas face at least one of (a) opposite end portions and (b) a central portion of the feeding member in a direction which directs along the medium-placed face and which is perpendicular to the feeding direction of the feeding mechanism.

6. The medium feeding apparatus according to claim 2, wherein the first low resistance member, the second low resistance member, and the intermediate member are disposed without any space in a direction which directs along the medium-placed face and which is perpendicular to the feeding direction of the feeding mechanism.

7. The medium feeding apparatus according to claim 2, wherein the first low resistance member, the second low resistance member, and the intermediate member are disposed such that at least one of the first low resistance member and the second low resistance member is distant from the intermediate member in a direction which directs along the medium-placed face and which is perpendicular to the feeding direction of the feeding mechanism.

8. A medium feeding apparatus comprising:

a feeding mechanism including a feeding member having a medium-placed face on which a recording medium is placed, the feeding mechanism being configured to feed the recording medium placed on the medium-placed face of the feeding member by moving the feeding member along a predetermined path;

an adsorbing unit including a first electrode and a second electrode each having a face facing a back face of the feeding member which back face is a face on the opposite side of the medium-placed face, the adsorbing unit being configured to adsorb the recording medium located on the medium-placed face to the medium-placed face by generating a potential difference between the first electrode and the second electrode;

a surface layer member formed of a material having a higher volume resistivity than any of the first electrode and the second electrode and stacked on the faces of the first electrode and the second electrode;

a first low resistance member formed of a material having a lower volume resistivity than the surface layer member and fixed, at a position between the surface layer member and the feeding member, to a face of the surface layer member which faces the back face of the feeding member; and a second low resistance member formed of a material having a lower volume resistivity than the surface layer member and fixed, at a position between the surface layer member and the feeding member, to the face of the surface layer member which faces the back face of the feeding member, wherein the first low resistance member and the second low resistance member are disposed so as to be distant from each other.

9. The medium feeding apparatus according to claim 8, further comprising an intermediate member provided at a position between the first low resistance member and the second low resistance member, wherein the first low resistance member, the second low resistance member, and the intermediate member are disposed such that the face of the first low resistance member which faces the back face of the feeding member, the face of the second low resistance member which faces the back face of the feeding member, and one of opposite faces of the intermediate member which one faces the back face of the feeding member are in one plane.

10. The medium feeding apparatus according to claim 8, wherein at least one penetrating area as at least one unformed area that is an area in which neither the first low resistance member nor the second low resistance member is formed is formed through each of at least one of the first low resistance member and the second low resistance member in a thickness direction thereof.

11. The medium feeding apparatus according to claim 10, wherein a high resistance member formed of a material having a higher volume resistivity than any of the first low resistance member and the second low resistance member is disposed in the at least one penetrating area.

12. The medium feeding apparatus according to claim 10, wherein the at least one penetrating area is a plurality of penetrating areas, and wherein the plurality of penetrating areas are formed at positions which are located on the first low resistance member and the second low resistance member and at which the plurality of penetrating areas face at least one of (a) opposite end portions and (b) a central portion of the feeding member in a direction which directs along the medium-placed face and which is perpendicular to the feeding direction of the feeding mechanism.

13. The medium feeding apparatus according to claim 9, wherein the first low resistance member, the second low resistance member, and the intermediate member are disposed without any space in a direction which directs along the medium-placed face and which is perpendicular to the feeding direction of the feeding mechanism.

14. The medium feeding apparatus according to claim 9, wherein the first low resistance member, the second low resistance member, and the intermediate member are disposed such that at least one of the first low resistance member and the second low resistance member is distant from the intermediate member in a direction which directs along the medium-placed face and which is perpendicular to the feeding direction of the feeding mechanism.

15. A medium feeding apparatus comprising:

a feeding mechanism including a feeding member having a medium-placed face on which a recording medium is placed, the feeding mechanism being configured to feed the recording medium placed on the medium-placed face of the feeding member by moving the feeding member along a predetermined path;

an adsorbing unit including a first electrode and a second electrode each having a face facing a back face of the feeding member which back face is a face on the opposite side of the medium-placed face, the adsorbing unit being configured to adsorb the recording medium located on the medium-placed face to the medium-placed face by generating a potential difference between the first electrode and the second electrode;

a first surface layer member formed of a material having a higher volume resistivity than the first electrode and stacked on one of opposite faces of the first electrode which one is nearer to the back face of the feeding member than the other of the opposite faces thereof;

a second surface layer member formed of a material having a higher volume resistivity than the second electrode and stacked on one of opposite faces of the second electrode which one is nearer to the back face of the feeding member than the other of the opposite faces thereof;

a first low resistance member formed of a material having a lower volume resistivity than the feeding member and fixed to the back face of the feeding member at a position between the first surface layer member and the feeding member; and a second low resistance member formed of a material having a lower volume resistivity than the feeding member and fixed to the back face of the feeding member at a position between the second surface layer member and the feeding member, wherein the first low resistance member and the second low resistance member are disposed so as to be distant from each other.

16. An image recording apparatus comprising:

the medium feeding apparatus as described in claim 1; and a recording head configured to perform a recording operation on the recording medium fed by the feeding mechanism.

* * * * *